US006875294B2

(12) United States Patent
Wood et al.

(10) Patent No.: US 6,875,294 B2
(45) Date of Patent: Apr. 5, 2005

(54) LIGHT METAL EXPLOSIVES AND PROPELLANTS

(75) Inventors: Lowell L. Wood, Simi Valley, CA (US); Muriel Y. Ishikawa, Livermore, CA (US); John H. Nuckolls, Danville, CA (US); Phillip F. Pagoria, Livermore, CA (US); James A. Viecelli, Orinda, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/293,659

(22) Filed: Nov. 12, 2002

(65) Prior Publication Data

US 2004/0256038 A1 Dec. 23, 2004

Related U.S. Application Data

(60) Provisional application No. 60/332,781, filed on Nov. 14, 2001.

(51) Int. Cl.[7] ..... C06B 45/10; C06B 47/10
(52) U.S. Cl. ..... 149/19.3; 149/22
(58) Field of Search ..... 149/22, 92, 19.3

(56) References Cited

U.S. PATENT DOCUMENTS

| | | | | | |
|---|---|---|---|---|---|
| 4,331,080 | A | | 5/1982 | West et al. | |
| 4,632,714 | A | | 12/1986 | Abegg et al. | |
| 5,175,022 | A | | 12/1992 | Stout et al. | |
| 5,529,649 | A | * | 6/1996 | Lund et al. | 149/19.3 |
| 6,315,847 | B1 | * | 11/2001 | Lee et al. | 149/109.6 |
| 6,576,072 | B2 | * | 6/2003 | Chan et al. | 149/19.2 |
| 2002/0005337 | A1 | | 1/2002 | Martin et al. | |

* cited by examiner

*Primary Examiner*—Aileen Felton
(74) *Attorney, Agent, or Firm*—Ann M. Lee; Alan H. Thompson

(57) ABSTRACT

Disclosed herein are light metal explosives, pyrotechnics and propellants (LME&Ps) comprising a light metal component such as Li, B, Be or their hydrides or intermetallic compounds and alloys containing them and an oxidizer component containing a classic explosive, such as CL-20, or a non-explosive oxidizer, such as lithium perchlorate, or combinations thereof. LME&P formulations may have light metal particles and oxidizer particles ranging in size from 0.01 $\mu$m to 1000 $\mu$m.

11 Claims, 2 Drawing Sheets

CL-20

CL-20

RDX

HMX

TNAZ

LIGHT METAL EXPLOSIVES AND PROPELLANTS

RELATED APPLICATION

This application is related to Provisional Application No. 60/332,781 filed Nov. 14, 2001 entitled "Optimally Formatted Light Metal Explosives and Propellants," and claims priority thereto under 35 USC 120. Provisional Application No. 60/332,781 is herein incorporated by reference in its entirety.

The United States Government has rights in this invention pursuant to Contract No. W-7405-ENG-48 between the United States Department of Energy and the University of California for the operation of Lawrence Livermore National Laboratory.

BACKGROUND

Classic high-energy explosives are homogeneous organic nitrates and/or amines, and mixtures thereof. These classic explosives derive most of their explosively-released enthalpy (ΔH) by formation of dinitrogen, CO, $CO_2$ and $H_2O$. Explosives based upon organic (poly)nitrates and (poly)amines are made to generate molecular (di)nitrogen and hydrogen-carbon-oxygen residue, with the large majority of total explosive energy release deriving from formation of the extraordinary dinitrogen triple-bond.

SUMMARY OF THE INVENTION

An aspect of the invention includes a formulation comprising: a plurality of light metal particles, wherein the light metal is selected from the group consisting of Li, Be, B, LiH, $LiBH_4$, $BeH_2$, $BeC_2$, $CB_4$, carboranes, decaborane ($B_{10}H_{14}$), $TiB_2$, $TaB_2$, $MgB_2$ and mixtures thereof, and a plurality of oxidizer particles; wherein the formulation has a total specific enthalpy-of-reaction greater than 1.98 Kcal/gram, as measured in a standard chemical calorimeter by standard physical chemistry techniques at a temperature of 298 Kelvin.

A further aspect of the invention includes a method comprising: mixing of a plurality of particles of at least one metal and a plurality of particles of at least one oxidizer, wherein the metal particles and the oxidizer particles are within a factor of 2 of the stoichiometric ratio of their component parts, wherein the mass-weighted average of the smallest of the 3 orthogonal dimensions of metal particles and of the oxidizer particles both range from 0.01 μM to 1,000 μM; and pressing the mixture to form a packed configuration to form a gas-poor metal pyrotechnic whose most stable oxide has specific enthalpy-of-formation greater than 1.98 Kcal/gram, as measured in a standard chemical calorimeter by standard physical chemistry techniques at a temperature of 298 Kelvin.

Another aspect of the invention includes a method comprising:

providing a formulation comprising a plurality of light metal particles, wherein the light metal is selected from the group consisting of Li, Be, B, LiH, $LiBH_4$, $BeH_2$, $BeC_2$, $CB_4$, carboranes, decaborane ($B_{10}H_{14}$), $TiB_2$, $TaB_2$, MgB, and mixtures thereof, and a plurality of oxidizer particles, wherein the formulation has a total specific enthalpy-of-reaction greater than 1.98 Kcal/g, as measured in a standard chemical calorimeter at a temperature of 298 Kelvin; pressing the formulation to form a packed configuration, such that the packed configuration has a theoretical maximum density (TMD) greater than 90%; adding a reaction-initiating device to the packed configuration; and actuating the reaction-initiating device to release chemical energy for explosive, pyrotechnics or propellant applications.

Another aspect of the invention includes a method comprising: providing a formulation, the formulation comprising a plurality of light metal particles, wherein the light metal is selected from the group consisting of Li, Be, B, LiH, $LiBH_4$, $BeH_2$, $BeC_2$, $CB_4$, carboranes, decaborane ($B_{10}H_{14}$), $TiB_2$, $TaB_2$, $MgB_2$ and mixtures thereof, and a plurality of oxidizer particles, wherein the formulation has a total specific enthalpy-of-reaction greater than 1.98 Kcal/g, as measured in a standard chemical calorimeter by standard physical chemistry techniques at a temperature of 298 Kelvin; pressing the formulation into a packed configuration, such that the packed configuration has a theoretical maximum density (TMD) greater than 90%; and initiating a chemical reaction in the packed configuration by electrical means.

Another aspect of the invention includes a method comprising: predetermining a value, z, wherein is between 0.01 μm and 1000 μm; mixing at least a) a plurality of light metal particles with b) a plurality of oxidizer particles, wherein the mass-weighted average of the smallest of the 3 orthogonal dimensions of either the light metal particles or the oxidizer particles is equal to z and the value of the mass-weighted average of the smallest of the 3 orthogonal dimensions of other particle type is less than z, wherein the formulation is non-reactive reactive at a first temperature, but swiftly reactive at-or-above a second temperature, the first temperature being lower than the second temperature; and determining the maximum reaction rate of the formulation from the value of z, at any temperature at least as high as the second temperature.

DETAILED DESCRIPTION

Figure 1:
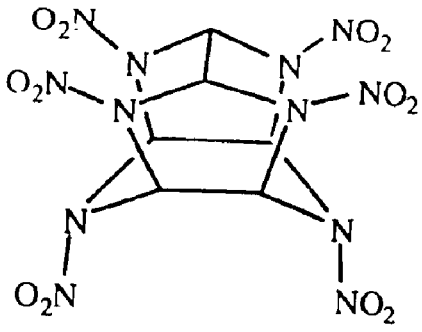
FIG. 1 shows the molecular structure of CL-20.

A reaction's free energy changes (ΔG) are related to the enthalpy changes (ΔH) and the entropy changes (ΔS) at a temperature T by the standard definition: $\Delta G=\Delta H-T\Delta S$. Thus, when the free energy of a reaction's product(s) is compared to the sum of free energies of the reactants, $\Delta G=G_{products}-G_{reactants}$, i.e., if the algebraic sum of the Gs of the reaction's products is greater-in-magnitude (less in algebraic magnitude, as G by convention becomes more negative when a reaction proceeds spontaneously) than the sum of the Gs of the reactants, the reaction proceeds spontaneously, typically with release of heat. For example, water at a temperature T of 300 K, at which the G of the product ($H_2O$) lies approximately 58 Kcal/mole below that of the sum of its reactants ($H_2$ and ½ $H_2O_2$), the reaction proceeds to fully oxidize hydrogen with oxygen. As a general rule, $S_{solids}<S_{liquids}<S_{gases}$. Thus, a system that involves reaction of solids to form gases is favored by the change in entropy (ΔS) upon reaction.

A chemical burn front propagates into a mass of a chemical explosive material by virtue of heat conducted from mostly-burned material at high temperature into the lower-temperature unburned material, augmented by hydrodynamic work done on the unburned material as a consequence of the much greater pressure of the adjacent, mostly-burned, far higher temperature, now-gaseous material. This increase of temperature results in an increase of the rate-of-reaction in the unburned material, with the rate generally increasing exponentially with the temperature (generally approximated by an Arrhenius relation, with an Arrhenius activation energy of the order of 1 eV/molecule). It is this exponential sensitivity of reaction-rate on temperature which permits homogeneous explosive materials to be stored for years at room temperature and yet to be burned in at most microseconds at temperatures just one order-of-magnitude higher.

By contrast, heterogeneous explosives must not only increase in temperature by a sufficiently large factor to react on microsecond time-scales, but the reductant and oxidizer jointly comprising such explosives must inter-diffuse in order to be able to react on the atomic scale before heat can be liberated to drive thermal and hydrodynamic transport of energy back into the unburned material in order to propagate the reaction. Such diffusive mixing may be quite slow, if the smallest dimensions of the particles comprising the reductant and oxidizer are nonetheless large; in addition, its temperature-dependence is generally quite weak, e.g., $T^{1/2}$, corresponding to thermal diffusion at mean-thermal speeds of atoms and molecules. Such diffusion doesn't even commence at significant rates until all materials are at least converted from solids into liquids with rising temperature, as liquid—liquid diffusion rates are over 10 orders of magnitude greater than the corresponding solid-state ones at comparable temperatures. The negligible rate of solid-state diffusion may be exploited quite productively in some circumstances, e.g., in propellants. Thus, it is desirable to design for the micro-explosive disruption of at least one species of particle in a heterogeneous explosive, which disrupts by gas-explosive dissociation at a temperature not much in excess of room temperature, thereby presenting effectively gasified metal atoms to oxidative action. For example, employing particles of $BeH_2$ in place of Be metal or $B_xH_y$ in place of B, replaces a high-melting metal with a nearly-equivalent substitute in terms of oxidative reaction enthalpy, but one which effectively gasifies at temperatures less than two-fold above room temperature. Materials may be tailored so that they disrupt or disperse violently upon a temperature-ump of as much as 3-fold above room temperature. For example, a low-boiling liquid core may be jacketed with a thick metal annular shell, such as a water micro-droplet coated with a shell of boron or beryllium, for use in pyrotechnic or propellant applications.

"Light metal component particles" in the present context include surface-passivated fine powders and fine powder-equivalent configurations (flakes, ribbons, filaments, etc. of lower symmetry than typically-spheroidal powders but having comparably high surface-to-volume ratios as fine powders and henceforth understood to also be implied when the term 'powder' is used) of Li, B and Be metals, LiH, $BeH_2$, solid borohydrides ($B_xH_y$), and intermetallic compounds, alloys and mixtures which contain at least 25% by weight of one or more of Li, Be or B, e.g., $LiBH_4$, $BeC_2$, carboranes, decaborane ($B_{10}H_5$), $TiB_2$, $TaB_2$, $MgB_2$, and mixtures thereof. Although LiH, $BeH_2$ and the solid borohydrides offer less space density of metal atoms in the case of B and Be than does the metallic form, these hydrides may have non-negligible free energy advantages relative to the metal, present the metal atoms in gas-exploded atomic form when flash-heated into dissociation without requiring a large investment of enthalpy, and contribute molecular hydrogen ($H_2$) to the final reaction-product mix, thereby lowering its mean molecule weight and usefully increasing the sound-speed in the reaction product gas.

Light metal explosives (LMEs) and light metal propellants and pyrotechnics (LMPs), hereinafter collectively referred to as LME&Ps, are heterogeneous mixtures of (1) the light metal component particles (as described above) and (2) oxidizers (aka electron acceptors). LME&Ps create an energy source for explosive, propellant and pyrotechnic applications. LME&Ps are generally comprised of a plurality of light metal particles intermixed with an oxidizer such as oxygen present in some suitable compound such as water, "rich" oxygen sources (e.g., perchlorates) or molecular oxygen itself; relatively low enthalpy-of-formation fluorides such as the $ClF_x$ compounds are other examples of suitable oxidizers. LME&Ps may additionally comprise a material (typically an elastomer) to add mechanical strength to the composition. Thus, LME&Ps are heterogeneous explosives or propellants and behave in a fundamentally different manner than do the classic explosives that are homogeneous organic nitramines.

LME&Ps derive most, and sometimes substantially all, of their explosively-generated enthalpy by forming high energy oxidation products of the light metals Li, Be and B, e.g., light-metal oxides. The total specific energy or "bang-for-pound" is potentially significantly higher than it is for the current-best classic high-energy explosives, i.e., greater than 1.98 Kcal/g as measured in a standard chemical calorimeter by standard physical chemistry techniques at a temperature of 298 Kelvin. For example, $B_2O_3$ and BeO have the highest $\Delta H$ of formation per gram of any known chemical compound. LME&Ps complete the 2p shell of oxidizers such as oxygen with electrons provided at singularly low mass-cost from the 2s or the 2p shells of the three lightest metals of the Periodic Table. Oxygen atoms are typically utilized as the reaction's electron-acceptor, thereby minimizing the mass of the oxidizer for a given energy yield: the figure-of-merit for LME&Ps is the energy-release per atomic mass unit involved in the energy-releasing reaction. However, the reaction's electron acceptor can be any compound comprised of at least 25%-by-weight nitrogen, oxygen, fluorine or chlorine, and whose enthalpy-of-formation from the constituent chemical elements (in the most stable form at standard temperature-and-pressure) at 298 Kelvin temperature is not more than 35 Kcal/gram-atom of Cl, 90 Kcal/gram-atom of F, 100 Kcal/gram-atom of O and 60 Kcal/gram-atom of N.

Several classes of LME&Ps are disclosed herein, hybrid LME&Ps, combination LME&Ps and pure LME&Ps. Hybrid LME&Ps comprise fine powders (i.e., mixtures having surface-to-mass ratios in the range from 10 to $10^6$ $cm^2$/gram) of classic explosives (e.g., organic nitramines, such as CL-20, HMX, RDX, TNAZ and mixtures thereof) mixed with fine powders of a reasonably-close-to-stoichiometric mass fraction (e.g., 10–30 weight percent) of the light metal component particles (as defined above) and generally (but not always) including 5–30 weight percent of a suitable binder, e.g., any member of the perfluoroethylene (PTFE), Teflon® or Viton® families of materials. The classic explosive component of hybrid LME&Ps behaves as the oxidizer for the light metal component. Aside from organic nitramines, such as CL-20, HMX, RDX and TNAZ, the classic explosive component of hybrid LME&Ps may comprise one or more of any organic compound having one or more interlinked benzoid rings with either amine (—$NH_2$) or nitro (—$NO_3$) groups attached to alternate carbon atoms of the interlinked rings.

Pure LME&Ps comprise mixtures of fine powders (i.e., mixtures having surface-to-mass ratios in the range of 10 to $10^6$ $cm^2$/gram) of the light metal component particles (as defined above) and a suitable non-explosive oxidizer, e.g., $LiClO_4$ or $NH_4ClO_4$. Combination LME&Ps include a mixture of both non-explosive oxidizers and classic explosives as the oxidizer materials. Combination LME&Ps are intended to be within the scope of the present invention. Liquid oxidizing materials, such as liquid oxygen (LOX) and 50–90% aqueous hydrogen peroxide solutions, are also potentially suitable oxidizers in some applications. In addition, the oxidizer may be the liquefied or solidified form of a chemical compound that is a gas at a temperature of 300 Kelvin and a pressure of 1 bar. The molar ratio of light metal to oxidizer may range from 1:2 to 2:1 (relative to the nominal stoichiometric ratio) and the weight fraction of binder may be anywhere from 0–50%. The mass-weighted average value of the smallest dimension of the 3 orthogonal dimensions of the light metal particles of LME&Ps ranges from 0.01 $\mu$m to 1000 $\mu$m and typically ranges from 0.1 $\mu$m to 150 $\mu$m, and the mass-weighted average value of the smallest dimension of the 3 orthogonal dimensions of the oxidizer particles of LME&P also lie in the range from 0.01 $\mu$m to 1000 $\mu$m.

When this smallest of the three orthogonal dimensions of the oxidizer or light metallic material powder is large compared to atomic scales, the kinetics of the chemical reaction between them are dominated by the interdiffusion times of the reactants:

$$t \cong (\Delta x)^2/D,$$

where t=the time-interval over which the diffusive process occurs, D=the fluid's diffusivity (approximately the mean free path of a constituent atom or molecule multiplied by its thermal speed), and $\Delta x$=the distance diffused in time-interval t. Thus, for a 1 micrometer diameter spherule of low molecular weight material at a temperature of the order of 1000 K, the diffusivity D is of the order of $10^4$ $cm^2$/sec, $\Delta x \cong 10^{-5}$ cm (corresponding to the outer 20% of a spherule's radius, which contains ~50% of the spherule's mass) and thus $t \cong 10^{-6}$ seconds. These reaction-rate-determining mass-transport kinetics determine the application-area of the LME&P. Very fine powders, e.g., particle diameters in the range of ~0.01 micrometer to 1 micrometer, are useful for swiftly generating high-pressure fluids for shell-pushing applications, e.g., accelerating a thin metallic plate for hydro-forming purposes, and coarser powders, e.g., particle diameters in the range of 10 microns to 1000 microns, are useful for propellant applications, i.e., generating reaction-mass for a rocket; as well as pyrotechnic applications.

Effective heterogeneously-detonating explosives are necessarily chemically homogeneous on multi-micrometer scale lengths, in that any multi-micron packet of such material will have the same chemical composition as any other, while heterogeneous propellants need not be chemically homogeneous in this sense until sampling scale-lengths of at least 500 micrometers are attained, due to the several orders of magnitude greater reaction time available in rocket combustion chambers of various sizes, relative to the at-most-microsecond time-scales of reaction in a chemical explosive detonation-front. Disclosed herein are classes of light metal-based, chemically-reacting mixtures, all featuring the light metal component particles (as defined above) as chemical reductants, that are completely homogeneous on molecular scales, highly heterogenous on substantially-larger than molecular scales but homogeneous once again on characteristic, far larger scales, and which offer energy releases per gram of material which are competitive to super-competitive with other materials currently available for explosive, pyrotechnic and propellant applications. Suitable LME&Ps may be comprised of a light metal component and an oxidizer/explosive component, wherein the oxidizer component comprises at least 25% (by weight) nitrogen, oxygen, fluorine or chlorine and whose enthalpy-of-formation from the constituent chemical elements at a temperature of 298 Kelvin is not more than 35 Kcal/gram-atom of Cl, 90 Kcal/gram-atom of F, 100 Kcal/gram-atom of O and 60 Kcal/gram-atom of N.

The time-scale upon which the reaction energy is released must be considered when working with these heterogeneous energetic materials. If this time is short compared to the prevailing hydrodynamic relaxation time-scale, then the burning will be completed well before the reacting materials cool by hydrodynamic expansion and disperse geometrically, while if the reaction time-scale is longer than the hydrodynamic one, the reacting materials will burn together only partially before the reaction is effectively shut down by cooling and expansion, possibly resulting in the release of too little specific energy to propagate the reaction and, in any case, failing to release the maximum amount of chemical energy from the mass of reacting material. The reaction-rate-limiting step in such circumstances is generally the inter-diffusion of one initially spatially-separated reactant into the other.

Reactant inter-diffusion is determined strongly by the smallest of the 3 orthogonal dimension characterizing reactant objects in the heterogeneous mixture, e.g., the smallest dimension or, in the case of a spheroidal body all three of whose orthogonal dimensions are comparable, the radius, with the characteristic inter-diffusion time-scale depending on the second power of the smallest of the unit dimension(s) of the largest particle sizes present (which generally dominate the mass-budget of the powder). Thus, as these particles shrink in size, their inter-diffusion time-scales and thus their specific reactivity increase as the inverse second power of their smallest dimension.

In addition, inter-diffusion doesn't commence at usefully large rates until both reactants (reductant and oxidizer) have liquefied. Temperature dependence is a factor for three main reasons. First, there is a step function in diffusivity at the melting temperature, below which the diffusive mixing essential to reaction is very slow and thus reaction effectively doesn't occur and above which the reaction takes place rapidly. Second, the reaction rate is generally exponential in temperature and, since the two components react as they inter-diffuse, this diffusion with chemical reaction process can proceed as swiftly as exponentially with temperature, e.g, when the temperature of the reactant particle becomes sufficiently high, the particle will evaporate and the associated diffusive-reaction time will drop precipitously. The maximum size of reactant particle which will support detonative burning (rather than slower deflagration) is a complex function of its physical format or size-and-geometry. Among the salient physical properties are the (assumed common) geometry of the reacting particles (i.e., whether it is spheroidal, ribbon-like, filament-like, flake- or sheet-like, etc.), the distribution in population of particle sizes in the heterogeneous mixture, the melting, boiling and critical temperatures of the material under applications conditions, the material's heats of transition and heat capacities in its solid and liquid ranges, its heat and stoichiometry of reaction, and its compressibility (which determines how much PdV work can be done on it by the adjacent high pressure detonation front). (See, e.g., Zel'dovich Ya. and Raizer Yu., *Physics of Shock Waves and High-Temperature Hydrodynamic Phenomena*, Chapter 8, Academic Press, New York, 1966.)

If detonation in heterogenous materials of present interest is to propagate steadily, particles in the unreacted explosive material-mixture must be heated to a temperature consistent with high-speed chemical reaction before they are swept into the center of the detonation-heated region. The material will be heated (predominantly hydrodynamically, in most cases of present interest) as it moves into the detonation front and, when at least one of its chemically-reactive components has liquefied, it will begin to react chemically at significant rates. By the time the outermost 3% in the radius of spheroidal reactant particles (about 10% of its mass) have reacted, sufficient heat typically has been liberated locally to vaporize the remainder of the particle, and the rest of the particle-burning proceeds substantially more rapidly due to the much higher diffusivity of the gaseous state in many circumstances of present interest (e.g., pyrotechnics and propellants, although not solid-density explosives). If the detonation-front width is ~0.1 cm (a characteristic value of the distance between the essentially unburned and the mostly-burned material), then the time t available for this initial diffusive reaction is $10^{-7}$ seconds, which corresponds to a diffusion distance $\Delta x=(Dt)^{1/2}$ of $(10^{-11}\ cm^2)^{1/2}$, or $3\times10^{-6}$ cm, when the mixing diffusivity D is taken to be $10^{-4}$ $cm^2$/sec. Thus, heterogeneous explosives of present interest comprised of particles with a radius of around 1 $\mu$m (which will thermally heat via diffusive radial transport in $\leqq 10^{-8}$ sec) will propagate a propagating chemical reaction process effectively indistinguishable from a detonation in a homogeneous explosive material, while much larger particles may only support deflagrative burning. Powders of Li, Be, and B hydrides will vaporize at far lower temperatures and with much less heat investment than will the parent light metals, so that metal-hydride particle sizes substantially larger than 1 micron radius may support stable propagation of detonations.

Powders of Li, Be, B, and their hydrides a few microns in diameter can readily be prepared, mixed and stored. Metal particles purchased in kilogram quantities with dimensions of 0.01 $\mu$m–0.1 $\mu$m (often referred to as "metal smoke") are routinely prepared by those skilled in the art, e.g., by condensation from supersonic nozzle-expanded streams of inert gas into which metal atomic vapor has been evaporated thermally, the pre-existing metal vapor pressure and nozzle properties determining the mean metal-particle size that results.

It is desirable that the mass-weighted average of the smallest of the 3 orthogonal dimensions of the light metal particles of LNE&Ps lie in the range from 0.01 $\mu$m to 1,000 $\mu$m. For explosives applications, it is preferred that the mass-weighted average of the smallest of the 3 orthogonal dimensions of the light metal particles of LME&Ps is less than 10 microns. For pyrotechnics applications, it is preferred that the mass-weighted average of the smallest of the 3 orthogonal dimensions of the light metal particles of LME&Ps range from 0.3 to 30 microns. For propellant applications, it is preferred that the mass-weighted average of the smallest of the 3 orthogonal dimensions of a weight majority of the light metal particles of LME&Ps range from 10 to 500 microns.

LME&P formulations, such as those disclosed herein, are non-reactive at a first temperature, but swiftly reactive at a second temperature, wherein said first temperature is lower than said second temperature. By controlling the smallest dimension of particles in an LME&P formulation, the reaction rate of the formulation can be determined in advance and thus, controlled. It is desirable that the second temperature is higher than said first temperature by a factor of at least 1.5.

Technically Distinguishing Heterogeneous Propellants from Heterogeneous Explosives The basic difference between solid explosives and propellants is the speed at which they release chemical energy: if the energy release time-scale is $\leqq 10^{-6}$ seconds, conventional practice is to label them explosives, while if the characteristic energy-release time is $\geqq 10^{-4}$ seconds, they're generally called propellants; pyrotechnics usually have intermediate time-scales. The operational distinction is whether the reaction products rarefy significantly before they fully react, but this is reaction geometry-dependent; they're nearly always incapable of rarefying for reactions which complete in <1 $\mu$sec, while they almost always can rarefy in >100 $\mu$sec, so the time-scale of reaction is more pertinent.

Intrinsically heterogeneous materials generally admit the ability to 'dial' the energy-release time-scales of all reactions of interest over essentially any range desired, simply by selecting the corresponding $material_2$–$material_2$ mixing time-scale—since the mixing of oxidizer with reducer (aka reductant) is the overall rate limiting step (inasmuch as intrinsic solid-state chemical reaction time-scales at temperatures of $\geqq$0.1 eV are of the order of picoseconds for any-and-all exoergic chemical reactions of present interest). The sole exception to this otherwise-general concept is when one of the two materials self-reacts to release significant specific energy, for example, as CL-20 would do as the classic explosive material in a hybrid explosive, or when employed in finely-divided form as a binder in a propellant grain.

The most convenient 'knob' for dialing this mixing time-scale—and thus the corresponding chemical reaction time-scale—is via control of the (mass-weighted averaged) particle sizes of the two materials. All liquids of present interest have a chemical mixing diffusivity $D_{chem}$ of the order of $10^{-4}$ $cm^2$/sec, and that of dense gases of present interest is simply $D_{chem}/(\rho_{gas}/\rho)$, where the term $(\rho_{gas}/\rho)$ is just the factor by which the material has rarefied from its solid or liquid form of density $\rho$. (Since the diffusivity, to within a factor of order unity, is simply $l_{mfp}v_{therm}$, where $l_{mfp}$ is the mean free path of the diffusing species and $v_{therm}$ is its mean thermal speed, the diffusivity at any given temperature varies linearly with the mean free path, i.e., inversely as the density.)

Now, spheroidal particles are "all surface," in that 3×% of their total volume (i.e., mass) lies within X % of the surface in fractional-radius terms, for X<<1. Specifically, ~10% of a spheroidal particle's mass lies within ~3% of its surface, in fractional-radius terms. As noted above, when this 10% of a particle's outermost mass has reacted chemically under the high $\Delta H_{reaction}$ conditions of present interest, its state has generally changed significantly (e.g., liquids have commenced to vaporize; low $\Delta H_{formation}$ compounds such as hydrides have started to decompose; etc.), and chemical diffusivities should be calculated differently, generally with substantially higher values (except in the case of explosives detonating entirely in condensed-phase circumstances). The time-scale $\tau_{10\%}$ for reacting this outermost 10% of the mass of a spheroidal particle in a chemical diffusion rate-limited manner thus is given by $$\tau_{10\%}=D_{chem}/\{d^2[0.015]^2\}=2.25\times10^{-4}\ D_{chem}/d^2$$

where d is the diameter of the assumed-spheroidal particle and the term in [ ] is the fraction of the particle's diameter −0.03 of its radius—whose outermost portion contains 10% of the particle's mass. For instance, for a 10 $\mu$m diameter spherule, taking $D_{chem}$ as $10^{-4}$ $cm^2sec^{-1}$, $\tau_{10\%}$ would be $(2.25_{-4})(1^{-4}/1_{-6})=2.25_{-6}$ seconds, or roughly 2 $\mu$sec. This illustrates why 3 microns are interesting and 30 microns are uninteresting as far as particle diameters-of-interest for heterogeneous explosives are concerned, and why 10 $\mu$m diameter particle-sizes represent something of a threshold or inter-regime transition value for heterogeneous explosives. In marked contrast, the thermal diffusivity of metals $D_{therm}$ is typically in the neighborhood of 1 $cm^2sec^{-1}$, and of dielectrics such as the metal oxides, in the neighborhood of 0.03–0.1 $cm^2sec^{-1}$; thus, the thermal time-constants of particles of interesting sizes in these systems are tiny compared to their chemical-reaction ones (as would be expected) and therefore can be taken to be effectively zero: the particles heat far more rapidly than their constituent atoms and molecules inter-diffuse and thus chemically react.

These basic geometric and physical-chemical considerations determine the particle-sizes—the powder dimensions, as defined above of interest for explosives, for pyrotechnics and for propellants; particle-sizes considerably smaller than 10 $\mu$M diameter are desirable for most explosive applications, while particle sizes of 30–300 $\mu$m diameter are generally optimal for propellant applications (depending on the particular chemical reactions and combustion-chamber dimensions), and particle-sizes for pyrotechnics applications are generally of intermediate size. The hydrodynamic rarefaction times-scales for the various classes of applications also must be considered. For instance, if the length-scale of a large adequately-tamped candidate explosive mass is a radius of 1 meter, then the pertinent hydro time is that required for a rarefaction wave to penetrate ~20% of its radius, or 50% of its mass, is 20 $\mu$sec, for a sound-speed of 1 cm/$\mu$sec ($1_6$ cm/sec). Any chemical-reaction time-scale far less than approximately 20 $\mu$sec thus may be taken to be effectively instantaneous in this system. A particle-diameter of much less than 20 $\mu$M (for a $D_{chem}$ of $10^{-4}$ $cm^2sec^{-1}$) therefore is "effectively zero," as particles of this size will react in less than a hydro time, and will contribute to the peak pressure and energy-density of the hydrodynamically-rarefying mass as though they had reacted instantaneously. Conversely, if we employ particles of diameter much greater than 20 $\mu$m, we can be assured that their 'burning' in a heterogeneous mixture will have the character of a deflagration, not a detonation; they can be employed as propellants with intrinsic operational safety (relative to the possibility of unwanted detonation).

LME&P Formulations of Hybrid Explosives and Propellants

Figure 2:
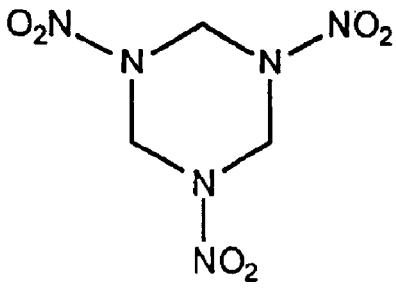
FIG. 2 shows the molecular structure of RDX.
Figure 3:
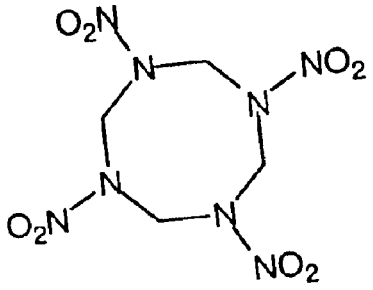
FIG. 3 shows the molecular structure of HMX.
Figure 4:
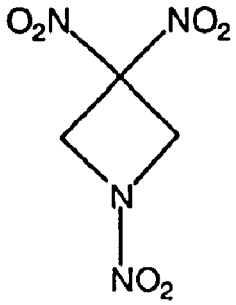
FIG. 4 shows the molecular structure of TNAZ.

The light metals boron, beryllium, lithium and their hydrides can significantly enhance the performance of existing chemical high explosives, particularly those that release an amount of oxygen at least sufficient to oxidize the indigenous carbon and hydrogen to CO and $H_2O$, respectively. These latter "oxygen-rich" explosives can readily supply oxygen for the oxidation of the light metal upon their detonation, thus increasing the enthalpy release and the total hydrodynamic or PdV work available from the hybrid in comparison to the explosive alone, simply because the oxides of the light metals have much larger enthalpies of formation per mole of oxygen than do the oxides of either carbon or hydrogen. These explosives also supply nitrogen in the form of dinitrogen, nitrogen oxides or nitrogen hydrides that may form nitrides with these light metals, further increasing the enthalpy released, as most of these light metals have higher enthalpies of formation for their nitrides per mole of nitrogen than do carbon, nitrogen or oxygen. CL-20 ($C_6H_6N_{12}O_{12}$), depicted in FIG. 1, Keto-RDX (K-6), depicted in FIG. 2, HMX, depicted in FIG. 3, and TNAZ, depicted in FIG. 4, are non-exclusive examples of high explosives that are effective in hybrid formulations of both explosives and propellants (the application determining the mixture ratios and particle sizes chosen, as described above).

Viton® A-100 is an elastomer produced by Dupont Dow Elastomers, L.L.C. It is made of a partially fluorinated hydrocarbon polymer that contains water and is widely used in energetic materials applications as a binder. In some applications, a binder such as Viton® A-100 is added to the LME&P formulation to provide the material with the desired degree of mechanical strength. Viton® A-100 has been used as the binder in most of the hybrid formulations because of its mechanical properties and the fact that it contains fluorine. (Boron does not combust completely to $B_2O_3$ in some LME&P formulations, but also forms $HBO_2$ (HOBO), thus decreasing the enthalpy release and the total PdV work available for explosive and propellant applications in oxygen-limited situations. Fluorine has been shown to aid the complete oxidation of boron to $B_2O_3$ by catalytically reacting with HOBO. Use of other chemical forms of boron such as decaborane ($B_{10}H_{16}$) or intermetallic compounds such as magnesium boride (MgB) can also result in complete boron oxidation, although ignition sensitivity and toxicity concerns may limit the usefulness of some of these compounds in some applications.)

Gas-Poor Light Metal Pyrotechnics (Gas-Poor LMPs)

Gas-poor LMPs, i.e., LMPs whose reaction products are largely liquids or solids at large multiples of room temperature, may be particularly useful in some pyrotechnics and explosives applications. Since the oxidation products (particularly the fluorides, oxides, nitrides and chlorides) of the light metals tend to be very high boiling-point materials, the reaction products of a substantial number of quite different formulations of LMPs may be made to have less than 20% of their total mass gaseous at a pressure of 1 bar and temperatures in excess of 1500 Kelvin. As a consequence, these gas-poor mixtures have effective gas-law gammas (the ratio of the specific heats at constant pressure and constant volume) that are not significantly greater than unity. Gamma values of 1.1 or less may be readily attained because only a small fraction of the total mass of the gas-poor mixture is present as gas (the remainder being liquid or solid) capable of converting internal energy into kinetic energy (or mechanical work) during hydrodynamic expansion. In other words, the large majority of the total mass of reacted material is present as "mist" or "snow" embedded within the gas from which it has condensed. Thus, these initially very hot fluids may be expanded while converting only a small fraction of their initial internal energy into kinetic or work energy. As a consequence, they remain remarkably hot during expansion to relatively very low densities and pressures. This unusual characteristic permits them to perform remarkably as pyrotechnic sources, e.g., as highly effective radiators of heat and light. The heat and light emission can persist for intervals very long (by a factor of at least 10-fold) compared to the intervals over which their chemical energy was released. If such material is ignited when surrounded by air, it will expand relatively slowly into a hot, low-density gas-bubble, eventually confined by surrounding cooler-and-denser air of roughly the same pressure, and will radiate as ultraviolet, visible and infrared light a much larger fraction of its total chemical energy release than would a classic explosive under the same circumstances. Non-exclusive examples of such gas-poor formulations include stoichiometric mixtures of any of Li, Be or B with $LiClO_4$.

Gas-Poor Metal Pyrotechnics (MPs)

Aside from the formulations described above, materials other than light metals can be used to create formulations that behave in a similar fashion to the gas-poor LMPs described above. This broad range of compounds will hereinafter be referred to as gas-poor metal pyrotechnics (gas-poor MPs). Any metal for which the heat of formation of its most stable oxide is in excess of 1.98 Kcal/g (e.g., Al and Mg) may be used to formulate gas-poor MPs. Suitable oxidizers include fluorides, oxides, nitrides and chlorides. These gas-poor MP formulations will have properties similar to the properties of the gas-poor LMPs described above resulting in formulations that perform remarkably as pyrotechnic sources, e.g., as highly efficient radiators of heat and light.

Materials Usage

Theoretical Maximum Density (TMD) refers to the expected density of a given formulation taking into account the theoretical (crystallized) density of each component and their respective percent of composition and assuming no voids in the formulation. For high explosive applications, a high percentage (i.e., greater than 95%) of the theoretical maximum density is desired, since the detonation pressure is related to the initial density ($\rho_o$) squared and the detonation velocity is directly related to $\rho_o$. For other explosive applications, a percentage of TMD greater than 85% is desired. The TMD value refers to the fraction of theoretical maximum value. To achieve a high TMD in an explosive formulation a multi-modal, e.g., at least trimodal, distribution of particle sizes is desired. Trimodal distribution refers to a combination of three distinctly different particle sizes of the various components and is described in more detail by A. E. Oberth in "Principles of solid propellant development", CPIA Publication 469, Published by Johns Hopkins University, Laurel, Md. (1987), which is hereby incorporated by reference. A trimodel distribution allows efficient mutual packing of the different particles sizes, thus increasing density and minimizing voids. For example, a formulation of CL-20/B/Viton® A is considered trimodal if 2 $\mu$m and 11 $\mu$m CL-20 particles are mixed with 8 $\mu$m boron particles. For explosive, pyrotechnics and propellant applications a TMD greater than 85% is sufficient.

LME&Ps can comprise powders of one or more light metal component particles (as defined above) intimately mixed with powders of one or more compounds comprised of at least 25 percent by weight nitrogen, oxygen, fluorine or chlorine whose enthalpy-of-formation from the constituent chemical elements (in standard temperature and pressure form) at 298 Kelvin is not more than 35 Kcal/gram-atom of Cl, 90 Kcal/gram-atom of F, 100 Kcal/gram-atom of O and 60 Kcal/gram-atom of N, and may be mixed with one or more classic explosives to comprise hybrid LME&P formulations.

Table 1 lists hybrid LME&P formulations that have been prepared and the small scale safety test results for these samples. The formulations resulted in soft materials that were made by the following process:

(1) Dissolve Viton® A-100 in acetone to make a 10% solution (2) The oxidizer and the light metal are submersed in acetone and added to the 10% Viton® A-100 solution (3) The acetone is removed under reduced pressure with vigorous agitation to insure good mixing (i.e., by rotary evaporation). A Cramer mixer may also be used in place of a rotary evaporator if larger quantities of the formulation are to be prepared.

TABLE 1

| LME&P Formulation* | Composition by Weight in grams | Thermal Analysis | Chemical Reactivity | Spark Sensitivity | Impact Sensitivity |
|---|---|---|---|---|---|
| CL-20/B/Viton ® A | 4.5/4.5/1 | 1/10 @ 12.0 kg | 0.191 | No | 13.1 |
| B/LiP/Viton ® A | 1.5/7.5/1 | 1/10 @ 14.4 kg | 0.005 | No | 16.4 |
| B/Viton ® A | 9/1 and 2/8 | 1/10 @ 34.2 kg | 0.033 | No | 167.5 |
| B/AP/LiP/Viton ® A | 2/4/4/1 | 1/10 @ 12.8 kg | 0.033 | No | 17.9 |
| B/AP/Viton ® A | 2/8/1 | 1/10 @ 8.0 kg | 0.031 | No | 20.7 |
| B/$MgB_2$/AP/Viton ® A | 1/1/8/1 | 1/10 @ 16 kg | 0.033 | No | 23.6 |
| AP/m-CB/Viton ® A | 8/1.5/1 | N/A | 0.009 | No | 17.4 |
| CL-20/AP/B/Viton ® A | 4/4/1/1 | 1/10 @ 12.8 kg | 0.02 | No | 11.1 |
| RDX/DB/Viton ® A | 7.5/1.5/1 | N/A | N/A | N/A | Very sensitive! |

*AP refers to ammonium perchlorate, LiP refers to lithium perchlorate, m-CB refers to meta-Carborane, DB refers to decaborane, Viton ® A refers to Viton ® A-100

Combinations of micronized (i.e., grinding the material to a small particle size of the order of 1 micron) boron and beryllium metals and their hydrides (primarily decaborane) with $NH_4ClO_4$, anhydrous $LiClO_4$, LOX and high-test $H_2O_2$ (50–90% aqueous hydrogen peroxide solutions) give higher specific enthalpies than do hybrid formulations, but are somewhat "harder starting" (i.e., the combustion is more difficult to initiate). Table 2 lists some formulations of interest, some containing beryllium based on the expectation that beryllium behaves similarly to boron and lithium in many instances.

TABLE 2

| LME&P Formulation* | Composition by mass-fraction |
|---|---|
| CL-20/B/Viton ® A | 4.5/4.5/1 |
| B/LiP/Viton ® A | 1.5/7.5/1 |
| B/Viton ® A | 9/1 and 2/8 |
| B/AP/LiP/Viton ® A | 2/4/4/1 |
| B/AP/Viton ® A | 2/8/1 |
| B/$MgB_2$/AP/Viton ® A | 1/1/8/1 |
| AP/m-CB/Viton ® A | 8/1.5/1 |
| CL-20/AP/B/Viton ® A | 4/4/1/1 |
| RDX/DB/Viton ® A | 7.5/1.5/1 |
| CL-20/Be/Viton ® A | 4.5/4.5/1 |
| Be/LiP/Viton ® A | 1.5/7.5/1 |
| Be/Viton ® A | 9/1 and 2/8 |
| Be/AP/LiP/Viton ® A | 2/4/4/1 |

TABLE 2-continued

| LME&P Formulation* | Composition by mass-fraction |
|---|---|
| Be/AP/Viton ® A | 2/8/1 |
| Be/$MgB_2$/AP/Viton ® A | 1/1/8/1 |
| CL-20/AP/Be/Viton ® A | 4/4/1/1 |

*AP refers to ammonium perchlorate, LiP refers to lithium perchlorate, m-CB refers to meta-Carborane, DB refers to decaborane, Viton ® A refers to Viton ® A-100

Table 3 lists formulation s anticipated to be effective based on computer modeling calculations. $\Delta E_{tot}$ refers to the total energy released upon complete decomposition of the reactants and formation of final products. The notation of 2.2 $V/V_o$, or 2.2 volume expansions, is regarded as the blast energy of the energetic material. The 2.2 datum refers to a point in the hydrodynamic expansion of the material at which the metal may not have been fully reacted, but where a significant amount of the homogeneous high explosive has already delivered its energy. By contrast, after the reacting mass has expanded by two orders-of-magnitude from its original volume (i.e., 100 $V/V_o$) the metal is fully reacted and much of the enthalpy-of-reaction has appeared as hydrodynamic energy, even in relatively gas-poor formulations. Thus, 91% "of CL-20 at 2.2 $V/V_o$" denotes 91% of the blast energy of pure CL-20 at 2.2 $V/V_o$, while 104% "of CL-20 at 100 $V/V_o$" indicates 104% of the blast energy of CL-20 at 100-fold expansion; CL-20 is the highest-performance classic explosive known. The final column in Table 3 relates the total energy in $KJ/cm^3$ released by each of the materials; the corresponding value for CL-20 is 16.5 $kJ/cm^3$, indicating that pure LME&P formulations yield relatively large fractions of their total energy-release only after sustained expansion, i.e., at late times, due to the "gas-poor" characteristics which many of them exhibit.

TABLE 3

| LME&P Formulation* | Composition by mass fraction | % of CL-20 at 2.2 $V/V_0$ | % of CL-20 at 100 $V/V_0$ | $\Delta E_{tot}$ in $KJ/cm^3$ |
|---|---|---|---|---|
| CL-20/B/Viton ® A | 80/10/10 | 87% | 103% | −14.7 |
| CL-20/Al/Viton ® A | 80/10/10 | 93% | 102% | −13.4 |
| AP/B/Viton ® A | 85/10/5 | 69% | 91% | −15.1 |
| AP/Al//Viton ® A | 85/10/5 | 59% | 71% | −15.1 |
| LiP/B//Viton ® A | 85/10/5 | 45% | 59% | −30.7 |
| CL-20/AP/B/Viton ® A | 40/40/15/5 | 79% | 104% | −20.20 |
| CL-20/AP/Al/Viton ® A | 40/40/15/5 | 83% | 104% | −15.8 |
| K-6/B/Viton ® A | 85/10/5 | 81% | 98% | −14.4 |
| AP/LiP/B/Viton ® A | 36/36/18/10 | 56% | 83% | −23.7 |
| AP/B/Mg/Viton ® A | 72/9/9/10 | 63% | 90% | −17.8 |

* AP refers to ammonium perchlorate, LiP refers to lithium perchlorate, m-CB refers to meta-Carborane, DB refers to decaborane, Viton ® A refers to Viton ® A-100

In the above-cited measurements, some CL-20 formulations utilized one particle size of CL-20 ranging from 6 $\mu$m to 30 $\mu$m along with a light metal of a different particle size. Other CL-20 formulations were trimodal, utilizing 2 $\mu$m and 11 $\mu$m CL-20 (obtained from Thiokol) along with a light metal of a different particle size, in order to attain higher compacted densities.

$NH_4ClO_4$ was formulated with boron because $NH_4ClO_4$ is well-known as a good oxidizer for metal-powder fuels. $NH_4ClO_4$ decomposes in part to ammonia ($NH_3$) and perchloric acid ($HClO_4$), corrosive gases that react rigorously when hot with the metal and the metal oxide layer to aid in combustion.

The $NH_4ClO_4/LiClO_4$ mixture has the advantages of $NH_4ClO_4$ plus the addition of the solid oxidizer, $LiClO_4$, which due to its higher density, higher oxygen fraction and favorable thermodynamics should improve performance.

The CL-20/$NH_4ClO_4$ formulations provide the detonation power of the high explosive along with a supplemental oxidizer to aid in the burning of the boron.

The $NH_4ClO_4$/carborane mixture may burn more swiftly than other forms of boron and may more efficiently support detonation propagation.

A class of intermetallic compounds, e.g., $CB_4$, $TiB_2$, $TaB_2$, $BeC_2$ and $MgB_2$, may facilitate rapid oxidation of boron or beryllium and thus be useful in some LME&P applications. LME&Ps as discussed can be used as explosives, propellants, or pyrotechnics. A reaction-initiating device is added to the LME&P formulation once it is pressed into a configuration appropriate to the particular application. Reaction-initiating devices include detonators and igniters. For most explosives applications, the light metal and the oxidizer/explosive components of a LME are packed into a containing structure and pressed such that after pressing, the sample has a TMD greater than 85% and for high explosive applications a TMD greater than 95%. A detonator or fast igniter is then placed in proximity to the LME material; when energized, the detonator or igniter launches the explosive chemical reaction. For propellant and pyrotechnic applications, the LMP material is loaded into a suitable container and, in most applications, pressed to near-theoretical density with 85% TMD being sufficient. This LMP material is then ignited by electrical means, e.g., by a thin metallic wire placed in or upon the pressed LMP and then heated or exploded with a pulsed electrical power supply. When energized, the igniter launches a deflagrative chemical reaction.

Computer Modeling

The above-cited modeling results have been derived via use of sophisticated physical modeling codes which run on high-performance digital computing systems.

The CHEETAH code is derived from more than 40 years of experiments on high explosives at Lawrence Livermore and Los Alamos National Laboratories. CHEETAH predicts the results from detonating a mixture of specified chemical reactants. It operates by solving thermodynamic equations to predict detonation products and such properties as temperature, pressure, volume, and total energy released. The code allows variation of the starting materials and conditions to optimize the desired performance properties. With its embedded chemical kinetics models, CHEETAH is able to predict the detonation speed of slowly-reacting materials such as PBXN-11 (a material with a detonation speed of 8 mm/$\mu$sec) to within 0.2 mm/$\mu$sec. CHEETAH is described in detail in L. Fried et al., CHEETAH 3.0, Energetic Materials Center, LLNL, 2001, which is hereby incorporated by reference.

CHEQ is a thermo-chemical code that computes equilibrium equations-of-state (EOS) for high explosive detonation products with ab initio-specified atomic compositions. It allows for the simultaneous presence of several phases of gases, liquids, or solids. Detonation product EOS are derived, using free energy models for each of the chemical species and phases, by adjusting the concentrations of each to minimize the Gibbs free energy of the system while maintaining conservation of the mole numbers of chemical elements. The free energy of detonation products in a fluid phase such as $CO_2$, CO, $N_2$ and $H_2O$ is modeled by a one-component van der Waals fluid with exponential-six potential parameters derived from weighted averages of potentials for the individual species. The code includes a free energy EOS for the various solid and liquid forms of carbon, a range of solid and liquid EOS models and also includes the Gibbs free energy lowering produced by fluid phase separation. CHEQ-calculated Hugoniots for a wide range of species such as $CO_2$, CO, $N_2$ hydrocarbons and plastics are in good agreement with data obtained from shock experiments. Hydrodynamic calculations of high explosive systems using detonation product EOS generated by CHEQ are in good agreement with experimental measurements for a wide range of high explosive-binder mixtures. CHEQ is described in detail by Francis H. Ree in "A statistical mechanical theory of chemically reacting multiphase mixtures: Application to the detonation properties of PETN," Journal of Chemical Physics, 81, 1251 (1984), which is hereby incorporated by reference.

Small-Scale Testing

Small-scale testing of energetic materials and related compounds is done to determine their sensitivity to various stimuli including thermal degradation, friction, impact and static spark. These tests are used primarily to outline parameters for safe handling and subsequent experiments that will characterize the behavior of the materials that may be stored for long time intervals. Representative results from such testing have been presented in Table 1.

Thermal Analysis: Differential Scanning Calorimetry (DSC) and Thermogravimetric Analysis (TGA)

Thermal analysis (DSC) run parameters used in LME&P materials characterizations cited in Table 1 are as follows: average sample mass ranged between 450 $\mu$g and 640 $\mu$g, weighed into a standard Perkin Elmer aluminum DSC closed pan; carrier gas is ultra high purity nitrogen at a flow rate of 50 $cm^3$/minute; temperature profile is ambient (approximately 23° C.) to 550° C.; four temperature calibration standards, i.e., indium, tin, lead and zinc, are used to linearize the temperature region of interest; an indium check standard is run to determine the accuracy and precision of the instrument which was 99.86% in agreement with the literature value for indium.

Chemical Reactivity Test (CRT) for Thermal Stability and Compatibility

A 0.25 gm sample, under a helium blanket, is immersed in a silicon oil bath for 22 hours at a temperature of 80° C., 100° C. and 120° C. A minimum of two runs per sample on each test sample was done for each of the results cited in Table 1. The immersion time of 22 hours and temperature from 80–120° C. may vary based on the characteristics of the particular sample. Helium is used to sweep off any gaseous products from thermal decomposition through a gas chromatograph that is programmed for the detection of $N_2$, $O_2$, Ar, CO, NO, $CO_2$ and $N_2O$. The results are given in terms of total gases evolved excluding Ar in units of $cm^3$/g. Arrhenius kinetics predict a material decomposition rate of 25 time greater at 120° C. than at 75° C., for a typical activation energy of 1 eV/molecule. PBX-9404 is used as the reference material that evolves 1.5 to 2 $cm^3$ of gas per gram of explosive. Any material under test that exhibits gas evolution twice as great as PBX-9404 is potentially thermally unstable and may require additional tests and/or evaluations.

Frictional Sensitivity Testing

The frictional sensitivity of the representative LME&P materials presented in Table 1 was evaluated using a B.A.M. high friction sensitivity tester. The tester employs a fixed porcelain pin and a movable porcelain plate that executes a reciprocating motion. Weight affixed to a torsion arm allows for a variation in applied force between 0.5 and 36 kg. The relative measure of the frictional sensitivity of the material is based upon the largest pin load at which more than two ignitions (events) occur in ten trials.

Spark Sensitivity Testing

The sensitivity of the representative LME&P materials presented in Table 1 toward electrostatic discharge is measured on a modified Electrical Instrument Services electrostatic discharge tester. Samples are loaded into Teflon washers and covered with a 1 mm thick Mylar tape. The sensitivity is defined as the highest energy setting at which 10 consecutive "no-go" results are obtained when using a 10 kV potential.

Impact Sensitivity Testing

An Explosives Research Laboratory Type 12 Drop Weight apparatus, more commonly called a "Drop-Hammer Machine" was used to determine the impact sensitivity of the representative LME&P materials of Table 1 relative to the primary calibrants PETN, RDX, and Comp B-3. The apparatus is equipped with a Type 12A tool and a 2.5 kg weight. The 35 mg+/−2 mg sample is impacted on a Carborundum "fine" (120-grit) flint paper. A "go" is defined as a microphone response of 1.3 V or more as measured by a model 415B Digital Peakmeter. The mean height for "go" events, called the "50% Impact Height" or $Dh_{50}$, is determined using the Bruceton up-own method.

All numbers expressing quantities of ingredients, constituents, reaction conditions, and so forth used in the specification and claims are to be understood as being modified in all instances by the term "about". All ranges expressed in the specification and claims are to be understood as inclusive of both end values given. Notwithstanding that the numerical ranges and parameters setting forth the broad scope of the subject matter presented herein are approximations, the numerical values set forth in the specific examples are reported as precisely as possible. Any numerical value, however, inherently contains certain errors necessarily resulting from the standard deviation found in their respective testing measurements.

While various materials, parameters, operational sequences, etc. have been described to exemplify and teach the principles of this invention, such are not intended to be limited. Modifications and changes may become apparent to those skilled in the art; and it is intended that the invention be limited only by the scope of the appended claims.

What is claimed is:

1. A formulation comprising:

a plurality of chemical reductant particles having a mass-weighted average of the smallest of the 3 orthogonal dimensions ranging from 0.01 $\mu$m to 1000 $\mu$m, wherein said plurality of chemical reductant particles is selected from the group consisting of Li, Be, B, LiH, $LiBH_4$, $BeH_2$, $BeC_2$, $CB_4$, carboranes, decaborane ($B_{10}H_{14}$), $TiB_2$, $TaB_2$, $MgB_2$ and mixtures thereof; and a plurality of oxidizer particles having a mass-weighted average of the smallest of the 3 orthogonal dimensions ranging from 0.01 $\mu$m to 1000 $\mu$m, wherein said oxidizer is a classic explosive or a mixture of classic explosives;

wherein said formulation has a total specific enthalpy-of-reaction greater than 1.98 Kcal/gram, as measured in a standard chemical calorimeter by standard physical chemistry techniques at a temperature of 298 Kelvin.

2. The formulation recited in claim 1, further comprising a fluorinated elastomer.

3. The formulation recited in claim 1, wherein said classic explosive comprises an organic compound having one or more interlinked benzoid rings with either amine (—$NH_2$) or nitro (—$NO_2$) groups attached to alternate carbon atoms of the interlinked rings.

4. The formulation recited in claim 3, wherein said organic compound is selected from the group consisting of CL-20, HMX, Keto-RDX (K-6), and TNAZ.

5. The formulation recited in claim 2, wherein said fluorinated elastomer is selected from the group consisting of a dipolymer of hexafluoropropylene and vinyliden fluoride, polytetrafluoroethylene, and perfluoroethylene.

6. The formulation recited in claim 1, wherein the molar ratio of chemical reductant particles to oxidizer particles ranges from 1:2 to 2:1 around the stoichiometric ratio of the reactants.

7. The formulation recited in claim 2, wherein the molar ratio of chemical reductant particles to oxidizer particles ranges from 1:2 to 2:1 around the stoichiometric ratio of the reactants.

8. The formulation recited in claim 2, wherein the weight fraction of fluorinated elastomer ranges from zero to 50%.

9. The formulation recited in claim 1, wherein the mass-weighted average of the smallest of the 3 orthogonal dimensions of the oxidizer particles ranges from 1 $\mu$m to 150 $\mu$m.

10. The formulation recited in claim 1 wherein the chemical composition of the chemical reductant particle, the oxidizer or both the chemical reductant particle and the oxidizer is selected so as to produce less than 20% by mass gaseous products at a pressure of 1 bar and a temperature of 1500 Kelvin.

11. The formulation recited in claim 1, wherein the mass-weighted average of the smallest of the 3 orthogonal dimensions of the chemical reductant particles ranges from 0.1 $\mu$m to 150 $\mu$m.

* * * * *